US005842585A

United States Patent [19]

Hollander

[11] Patent Number: 5,842,585

[45] Date of Patent: Dec. 1, 1998

[54] MOVABLE SHELF ARRANGEMENT

[75] Inventor: Rudolf R. Hollander, Vorden, Netherlands

[73] Assignee: NEDCON Magazijninichting B.V., Doetinchem, Netherlands

[21] Appl. No.: 702,313

[22] Filed: Aug. 23, 1996

[30] Foreign Application Priority Data

Apr. 18, 1996 [EP] European Pat. Off. ..... 96106050

[51] Int. Cl.[6] ..... A47F 5/00

[52] U.S. Cl. ..... 211/162; 108/106; 312/201; 211/175

[58] Field of Search ..... 211/162, 175, 211/1.51, 1.55, 1.57; 108/106; 312/201, 301, 306, 319.5, 319.8, 330.1, 334.4, 334.5, 349

[56] References Cited

U.S. PATENT DOCUMENTS

| | | | |
|---|---|---|---|
| 4,307,922 | 12/1981 | Rhodes, Jr. | 211/1.57 X |
| 4,412,772 | 11/1983 | Naito et al. | 211/157 X |
| 4,615,449 | 10/1986 | Naito et al. | 211/162 |
| 4,733,923 | 3/1988 | Dahnert | 312/201 |
| 4,743,078 | 5/1988 | Dahnert | 312/201 |
| 4,991,725 | 2/1991 | Weisch et al. | 312/201 X |
| 5,160,189 | 11/1992 | Johnston et al. | 312/201 |
| 5,160,190 | 11/1992 | Farrell et al. | 312/201 |
| 5,333,983 | 8/1994 | Hatouchi et al. | 211/1.57 X |
| 5,359,191 | 10/1994 | Griesemer et al. | 312/201 X |
| 5,417,487 | 5/1995 | Dahnert | 312/201 |
| 5,427,444 | 6/1995 | Griesemer | 312/201 |
| 5,569,910 | 10/1996 | Griesemer | 312/201 X |

FOREIGN PATENT DOCUMENTS

| | | |
|---|---|---|
| 2518946 | 7/1983 | France . |
| 1594872 | 5/1978 | United Kingdom . |
| 2217879 | 11/1989 | United Kingdom . |
| 2270999 | 3/1994 | United Kingdom . |

*Primary Examiner*—Ramon O. Ramirez
*Assistant Examiner*—Kimberly Wood
*Attorney, Agent, or Firm*—Robert W. Becker & Associates

[57] ABSTRACT

A movable shelf arrangement has individual shelf members and tracks connected to the floor and extending parallel to one another perpendicular to the longitudinal extension of the shelf members. A set of wheels is connected to each one of the shelf members for moving the shelf members on the tracks. At least some of the wheels of the set of wheels are driven. A drive is connected to each one of the driven wheels. A sensor arrangement is connected to each one of the shelf members for sensing alignment and lateral displacement of the wheels relative to the ideal line of movement on the tracks. A drive control unit is connected to each one of the driven wheels for receiving corrective control signals based on the detection signals of the sensor arrangement in order to correct the driven wheels with respect to alignment with the ideal line of movement.

10 Claims, 3 Drawing Sheets

MOVABLE SHELF ARRANGEMENT

BACKGROUND OF THE INVENTION

The present invention relates to a movable shelf arrangement with a plurality of shelf members which are supported with a plurality of wheels on tracks connected to the floor and extending parallel to one another. At least some of the wheels are driven. The driven wheels cooperate with adjusting means in order to align the wheels relative to the tracks.

Such movable shelf arrangements are known in a plurality of embodiments and in various sizes. Small movable shelf arrangements are, for example, known in office environments for receiving a large amount of files within a small area. The same principle is also known for large scale storage facilities. The individual movable shelf members can have a length of up to 50 meters and more. Such movable shelf members are used to receive, for example, loaded industrial pellets in two rows one after another as well as in a plurality of rows above one another.

In order to prevent that for a slightly canted position of the shelf members its wheels during displacement leave the parallel extending tracks, it is known to provide the so-called guide wheels with wheel flanges the inwardly facing surfaces of which achieve guiding of the wheels by resting at the lateral surfaces of the tracks at one or both sides. The tracks are therefore in the shape of rails with a horizonal running surface and two lateral guide surfaces.

Shelf members with wheel flanges for guiding the wheels have been proven successful in practice and do not cause any difficulties in operation as long as the individual shelf members are not too long. For optimizing the storage surface area available with such systems, it is, however, desired to design the shelf members with even greater lengths, for example, total lengths of 50 meters and more. Such large size shelf arrangements, however, no longer operate with the same reliability as those of smaller constructive size.

The reason for this is that a non-uniform distribution of the load such that one of the ends of a shelf member has a greater load to carry than the other is much more detrimental in especially long shelf member constructions than in shorter shelf members. At the ends carrying the great load the wheel drive thus operates at correspondingly high supporting loads and thus substantially free of any slip. At the less loaded end of the shelf member, however, it is possible that slip of the wheels occurs during start-up and braking operations so that in the end minimal deviations of the alignment of the shelf member from the desired alignment exactly perpendicular to the longitudinal extension of the tracks may occur. Such a slight canting is of no consequence for short shelf members; however, for long shelf members this results in the risk of collision of one of the wheel flanges. The vertical forces acting on the flange of the wheel flange surpass the weight forces so that the wheel flange may come to rest at the horizontal support or load surface of the rail or may even be displaced onto the concrete floor. This may result in damage to the concrete floor. Furthermore, the return of the wheel onto the rail presents considerable difficulties and in certain circumstances can only be performed with the aid of hydraulic lifting devices.

The tendency for displacement of a wheel flange-equipped guide wheel can be reduced and possibly completely avoided by positioning the individual tracks exactly parallel to one another within the floor. However, this cannot be ensured in practice to the full extent since the tracks are embedded in concrete which during curing undergoes a natural shrinking process so that deviations in the parallel arrangement of the individual tracks cannot be completely prevented.

Furthermore, it is disadvantageous, especially for very long shelf members, that longitudinal deviations occur as a result of temperature fluctuations. While the shelf members are comprised substantially of metal, the tracks are embedded in a floor covering comprised of shrinking concrete which has different temperature properties than the metal. For especially low or especially high temperatures, this results in the risk of canting of the wheel flange-guided wheel.

A further disadvantage is that a jamming of a foreign body between two neighboring shelf members can result in canting of the wheel flange guided wheel and thus in derailing of the shelf member. If the foreign body is jammed at one end of the shelf member, this also results in a considerable leverage acting on the opposite end of the shelf member so that at the opposite end forces result which can quickly result in canting and derailing. Inspite of respective safety systems, which upon encountering resistance due to a foreign body shut down the drive system, with such arrangements the aforementioned dysfunctions cannot be completely avoided especially since the systems are designed to detect a foreign body only at a level of 10 to 30 mm.

Furthermore, the known wheels with wheel flanges are subject to considerable wear which increases with increasing length of the shelf member due to the increasing canting tendency. For example, the wear for a shelf member having a length of 30 meter is substantially greater than the wear of a shelf member having only a length of 15 meter.

It is therefore an object of the present invention to provide a shelf arrangement comprised of a plurality of movable shelf members which operates with reduced wear and with which a greater length of the individual shelf members is possible as compared to conventional movable shelf arrangements. Furthermore, a method is to be provided which controls the displacement movement of the individual shelf members for such movable shelf arrangements.

SUMMARY OF THE INVENTION

A movable shelf arrangement according to the present invention is primarily characterized by:

Individual shelf members;

Tracks connected to a floor and extending parallel to one another perpendicular to a longitudinal extension of the shelf members;

A set of wheels connected to each one of the shelf members for moving the shelf members on the tracks;

At least some of the wheels of the set of wheels being driven;

A drive connected to each one of the driven wheels;

A sensor arrangement connected to each one of the shelf members for sensing alignment and lateral displacement of the wheels relative to an ideal line of movement on the tracks and producing respective alignment and lateral displacement signals;

A drive control unit connected to each one of the drive wheels for correcting the drive wheels in order to align the wheels with the ideal line of movement based on the respective alignment and lateral displacement signals.

Advantageously, the ideal line of movement is the center line of the track.

Advantageously, the sensor arrangement is comprised of sensing elements, fastened to the shelf member and connected to the drive control units, and at least one reference element in the form of a stationary, elongate profile member having the same length as the tracks.

Preferably, two of the tracks are arranged at opposite ends of the shelf members and the reference element is positioned adjacent to one of the two tracks so as to be spaced from a respective one of the opposite ends.

Preferably, two of the tracks are arranged at opposite ends of the shelf members and the reference element is positioned above one of the tracks.

Advantageously, one of the tracks is the reference element.

Preferably, the sensor arrangement comprises at least four of the sensing elements, the sensing elements divided into a first and a second group.

The sensing elements of the first group are preferably arranged in a common plane close to one longitudinal side of the shelf member and the sensing elements of the second group are arranged in a common plane close to the other longitudinal side of the shelf member.

Preferably, the first group and the second group each comprise two of the sensing elements, wherein, for a neutral, aligned position of the wheels, the two sensing elements of the first and the second groups, respectively, have a same spacing from the center line of the reference element.

Expediently, the reference element has an upper side with longitudinal edges and the sensing elements are designed to respond to the longitudinal edges.

The present invention also relates to a method for controlling the movement of a shelf arrangement comprising individual shelf members, tracks connected to a floor and extending parallel to one another perpendicular to the longitudinal extension of the shelf members, a set of wheels connected to each one of the shelf members for moving the shelf member on the track, at least some of the wheels of said set of wheels being driven, a drive connected to each one of the driven wheels, a sensor arrangement connected to each one of the shelf members, a drive control unit connected to each one of the driven wheels wherein the method according to the present invention is primarily comprised of the following steps:

Continuously monitoring the actual alignment and the actual lateral displacement of the wheels relative to the ideal line of movement with the sensor arrangement;

Comparing the actual alignment and the actual lateral displacement to respective preset threshold values;

Correcting at least one of the actual alignment and the actual lateral displacement, when a deviation from the respective preset threshold value has been detected, by sending a corrective control signal to at least one of the drive control units, wherein correction is achieved by at least one of the steps of driving the drive wheels at different rpm and activating the drive wheels at different times.

According to the present invention it is thus suggested to provide the driven wheels with separate drives, to provide a sensor arrangement for detecting the alignment and the lateral displacement of the wheels relative to the predetermined ideal line along the tracks, and to provide drive control units for the driven wheels that control the driven wheels based on the signals received from the sensor arrangement.

For such a shelf arrangement the lateral guiding relative to the tracks thus no longer is performed with wheel flanges fixedly connected to the wheels, but is achieved by using a sensor arrangement for detecting the alignment and the lateral displacement of the wheels relative to a predetermined ideal line of movement along the tracks. The drive control and especially the corrections for controlling the separately driven wheels thus is performed as a function of the signals of this sensor arrangement.

An important advantage of such shelf arrangements is the considerably reduced wear relative to conventional constructions in which lateral guiding is achieved with wheel flanges fixedly connected to the wheels. The wear in the present invention thus is limited to the conventional wear at the circumferential surface of the wheels which, however, only requires an infrequent replacement of the wheels.

A special advantage of the present invention is furthermore that derailing, i.e., at least one of the wheels leaving the track, does no longer occur. This is also true in cases in which a foreign body is jammed between two neighboring shelf members so that the movement of one of the shelf members is impeded.

It is furthermore advantageous that a parallel alignment of the individual tracks relative to one another is no longer of such critical importance as for known movable shelf arrangements with wheel flange-guided wheels. Also, temperature fluctuations have no longer such a great impact onto the exact guiding as in known movable shelf arrangements. Furthermore, an unevenness of the tracks as, for example, with slight floor depressions can be compensated better with the inventive shelf arrangement as with shelf arrangements of the prior art.

The inventive shelf arrangement is also substantially less sensitive to non-uniform loading. Slip of the wheels caused by loading errors is immediately detected by the sensor arrangement since such a non-uniform loading results in a deviation of the alignment of the wheels relative to the predetermined ideal line and can thus be immediately compensated by a corresponding control of the wheels performed by the drive control unit.

Furthermore, the measures of the present invention make the rails of the prior art, including load or support surfaces as well as the two lateral guides for the wheel flanges, obsolete. Instead, the tracks can be embodied as a planar surface, especially flush with the floor surface so that a fork lift or other transporting vehicle moving across the tracks does not encounter bumps.

According to one embodiment of the shelf arrangement it is suggested that the sensor arrangement is comprised of sensing elements connected to the drive control units and at least one reference element and that the sensing elements are attached to the shelf member while the reference element is a stationary elongate profiled member which has exactly the same length as the tracks. According to a first alternative, the reference element is positioned external to the two outwardly positioned parallel tracks. According to a second alternative, one of the tracks itself is the reference element.

An especially simple and safe detection of the alignment and the lateral displacement of the wheels relative to the predetermined ideal line is possible when the sensor arrangement for each shelf member comprises at least four sensing elements arranged in two groups. For achieving an excellent detection precision the sensing elements of the first group can be arranged in a common plane in the vicinity of the front side (first longitudinal side) of the shelf member and the sensing elements of the second group can be positioned in a second common plane in the vicinity of the back side (second longitudinal side) of the shelf member.

According to a preferred embodiment of the sensor arrangement, each group is comprised of two sensing elements which, in a neutral alignment of the wheels relative to the ideal line, have the same spacing to the center line of the reference element.

The upper side of the reference element can be a surface delimited on both sides by longitudinal edges whereby the sensing elements are designed such that they detect these longitudinal edges. This embodiment allows for a flat construction of the reference element so that, in general, it is flush with the floor and a forklift traveling across will not encounter a bump.

The present invention also suggests a method for controlling the displacement travel of shelf members of a shelf arrangement in which it is suggested that with the sensor arrangement the alignment and the lateral displacement of the wheels relative to a predetermined ideal line is monitored continuously, that in case of the alignment and/or lateral displacement surpassing a predetermined minimum value the drive control units are controlled in order to correct the alignment/lateral displacement of the wheels and that the correction is achieved by different rpm of the driven wheels and/or by controlling the driven wheels of the shelf member at different times.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 3*d*.

Figure 1:
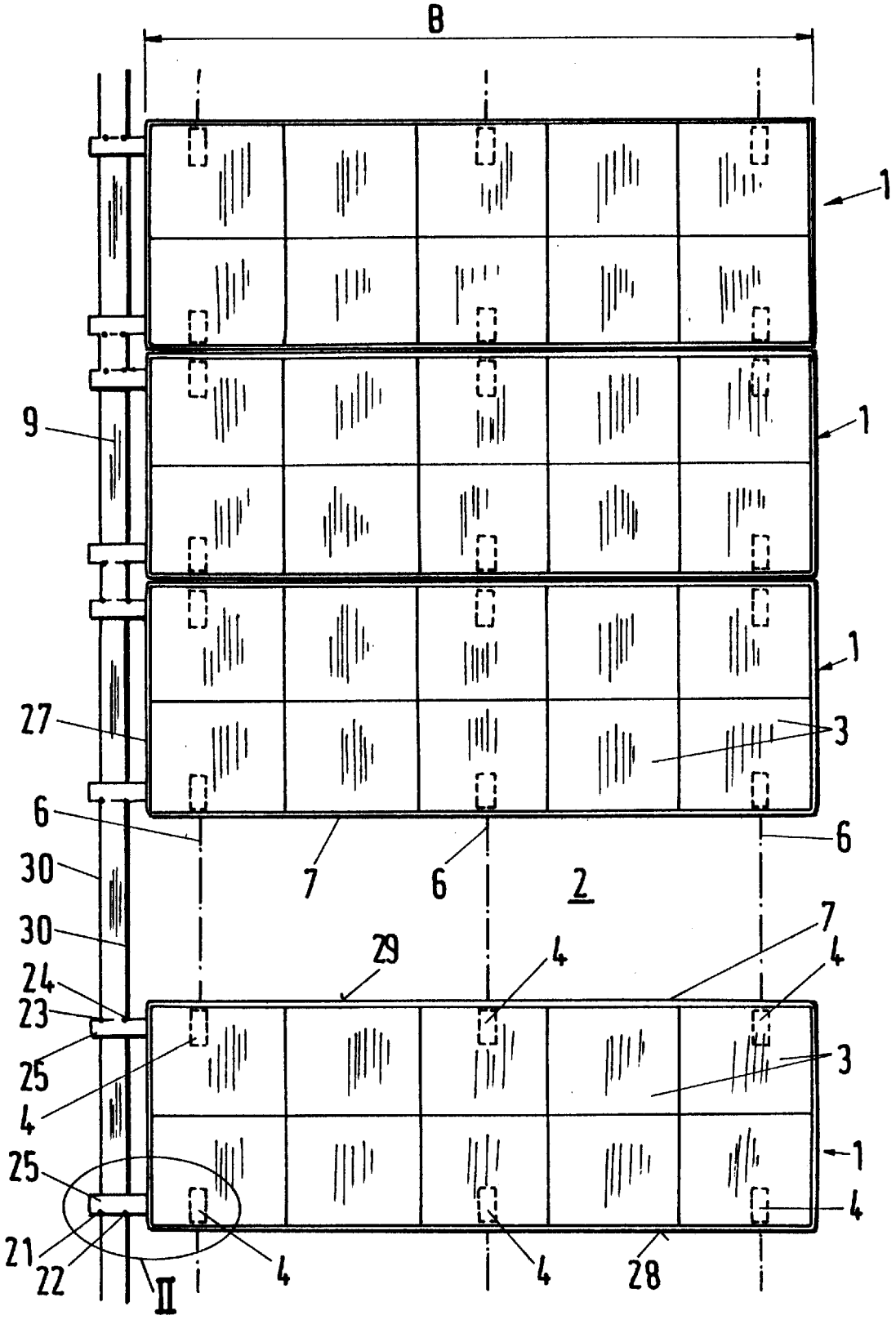
FIG. 1 is a plan view of a shelf arrangement with a total of four shelf members.

FIG. 1 shows in a plan view and partly greatly simplified a shelf arrangement comprised of a total of four shelf members 1. Each shelf member 1 is comprised of a support frame consisting of metal profiled member. In contour it forms a rectangular box. In various planes of this box storage surfaces are provided on which loaded industrial pallets or other wares can be stored. The shelf members 1 are displaceable (movable) so that between two adjacent shelf members 1 an aisle 2 can be opened into which a fork lift or other transport vehicle can be moved in order to transport wares into the shelfs or remove wares from the shelfs. Compartments 3 for the respective pellets or wares are provided on either side of the aisle 2.

Each shelf member 1 is supported with wheels 4 on tracks 5 extending in the displacement direction of the shelf members 1. For reasons of simplification of the drawings, FIGS. 1 and 3*a* to 3*d* show the tracks 5 only as a respective center line 6. The flat and planar tracks 5 are wider, preferably twice as wide, as the contact surface of the wheels 4.

In the embodiment shown, each shelf member 1 is supported with a total of six wheels 4 on three tracks 5. However, this number can vary and depends on the length B of the shelf member 1. This length, without requiring any deviations of the constructive design, can be 50 meters or more.

At least some of the wheels 4 are provided with their own drive, but individual wheels, especially those at the center of the shelf member, can be free wheeling. At least one of the outwardly positioned wheels 4 however must comprise an individually controllable drive, preferably, a relay-controlled synchronous drive motor.

The longitudinal sides of the shelf members 1 are provided in the vicinity of the bottom with a safety means 7 extending over the entire length which, upon contacting an obstacle, shut down the current supply to the drive motors in order to cause an immediate stop of the arrangement when a foreign body is jammed between two shelf members 1.

Figure 2:
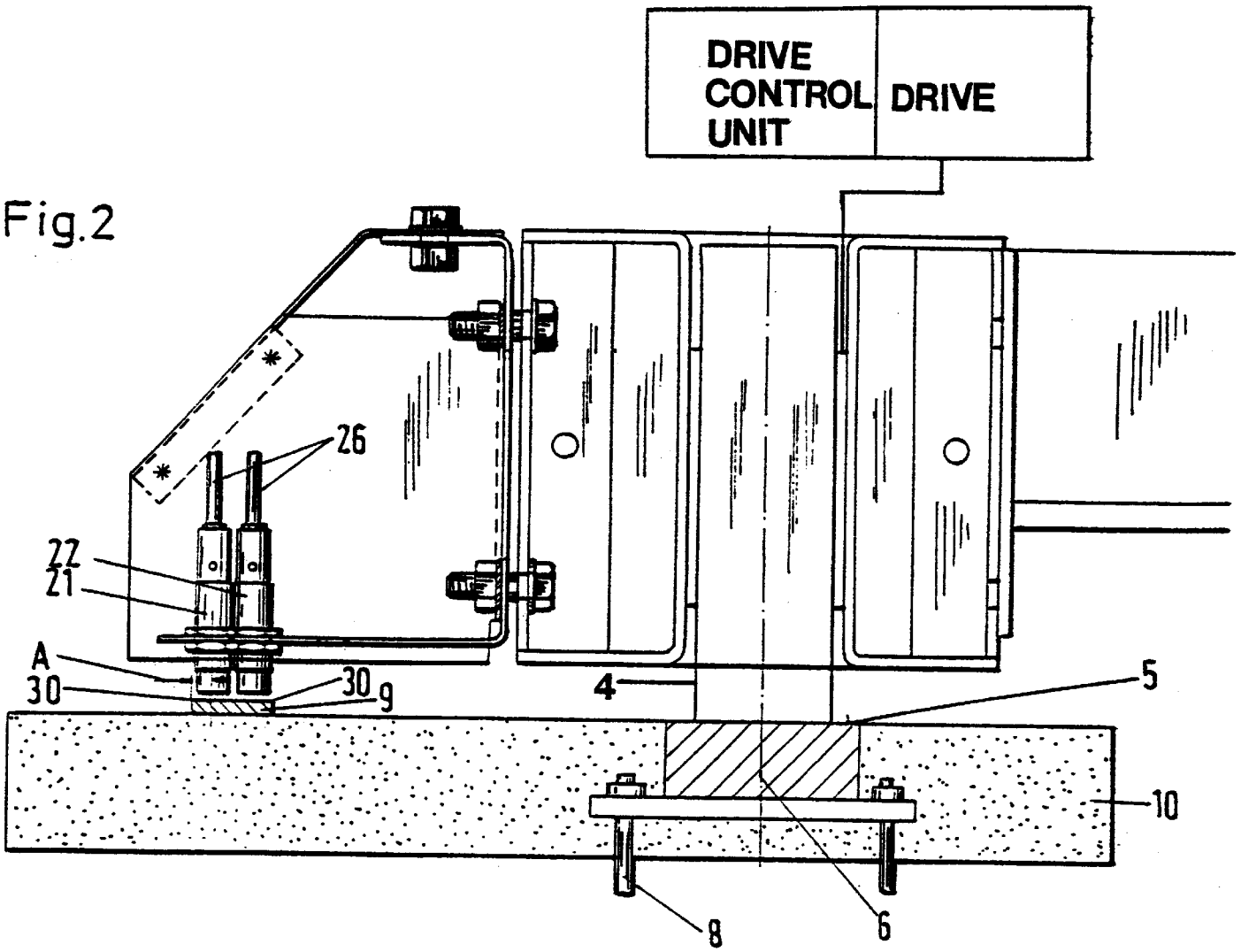
FIG. 2 shows in a vertical section a detail II of FIG. 1.

Details of the design of the wheels as well as of the track 5 are represented in FIG. 2. The wheels 4 have a substantially cylindrical contact or running surface which extends over the entire width of the wheel. A wheel flange or other mechanical devices for centering the wheels relative to the center line 6 of the rail are not needed. The track 5 is embedded in the concrete matrix 10 of the floor and thus forms with its upper side the flat and planar track 5 at the upper side of the concrete layer. Anchoring elements 8 also help to anchor the track 5 within the concrete matrix 10 so that a temperature-caused warping of the track within the concrete matrix is prevented.

In the disclosed embodiment a reference element 9 extends parallel to the tracks 5 and is in the form of a flat metal profile member. The reference element 9 is also anchored within the concrete matrix 10 or is secured in any other suitable manner to the floor. At a short distance above the reference element 9 the four sensing elements 21, 22, 23, 24 are connected to the shelf member 1. The sensing elements 21–24 are fastened to the supports 25 which are attached with screws to the narrow side of the shelf member 1. In the embodiment represented in FIG. 2 the sensing elements 21 to 24 are proximity sensors which are designed such that they can detect whether below them the reference element 9 or the free surface of the concrete matrix 10 is present.

Via signal lines 26 the sensing elements 21–24 are connected to a control device for processing the detection signals which is, in turn, connected to the individual drive control units of the driven wheels 4. The control device can be mounted within the respective shelf member 1. However, there can be a central control device for the shelf arrangement which processes all measured signals and all drive commands for all shelf members with suitable electrical connections.

It is also possible to use instead of the additional reference element 9 in the form of a metal profile member one of the tracks 5 as a reference element in which case the sensing elements 21–24 are positioned slightly above the track 5 comprised of metal.

When installing the shelf arrangement it is especially important to exactly install the reference element 9 because this element must be aligned exactly to an ideal line along which the wheels 4 must move on the tracks 5. For the purpose of uniform loading, the ideal line is identical to the center line 6 of the track 5. For fine adjusting relative to the reference element 9, the sensing elements 21–24 are connected in transverse guides at the support 25 so that they can be adjusted in the lateral direction. A height adjustment relative to the upper side of the elongate reference element 9 is also possible.

The reference element 9 as well as the support 25 with the sensing elements 21–24 are positioned, in order to save space, at the narrow side 27 of the shelf member 1 which, in general, is positioned close to the sidewall of the warehouse. In this manner, the support 25 does not impede the transport movement of the fork lift.

The sensing elements 21–24 together with the reference element 9 thus form the sensor arrangement with which, in connection with the control device, a guiding of the wheels of the shelf member is provided and which takes over the function of the missing mechanical guides in the form of wheel flanges.

The four sensing elements 21–24 are divided into two groups whereby the first group 21, 22 is positioned in a common plane in the vicinity of the front side 28 of the shelf member 1 and the second group 23, 24 is positioned in a plane in the vicinity of the back side 29 of the shelf member 1. A distance between the two groups as large as possible is desirable in order to achieve the greatest possible precision.

The distance between the two sensing elements 21, 22, respectively, 23, 24 of each group is adjusted to the width of the reference element 9 extending therebelow. In neutral position, i.e., with wheels 4 positioned on and aligned with the ideal line 6, the two sensing elements of each group are positioned above the reference elements 9 and are positioned at a certain lateral distance A to its longitudinal edges 30. This means that the shelf member 1 can be laterally displaced by the distance A without deviations being detected by the sensing elements 21 to 24. As soon as the measuring beam of the sensing elements 21–24 leaves one of the longitudinal edges 30 of the reference element 9, a respective detection signal is produced and sent to the control device, where it is processed to produce a respective corrective control signal for the drive control units.

Details of the guiding principle of the shelf member 1 along the tracks 5 will now be explained in detail with the aid of FIGS. 3*a* to 3*d* in which various situations are represented.

Figures 3A, 3B, 3C, 3D:
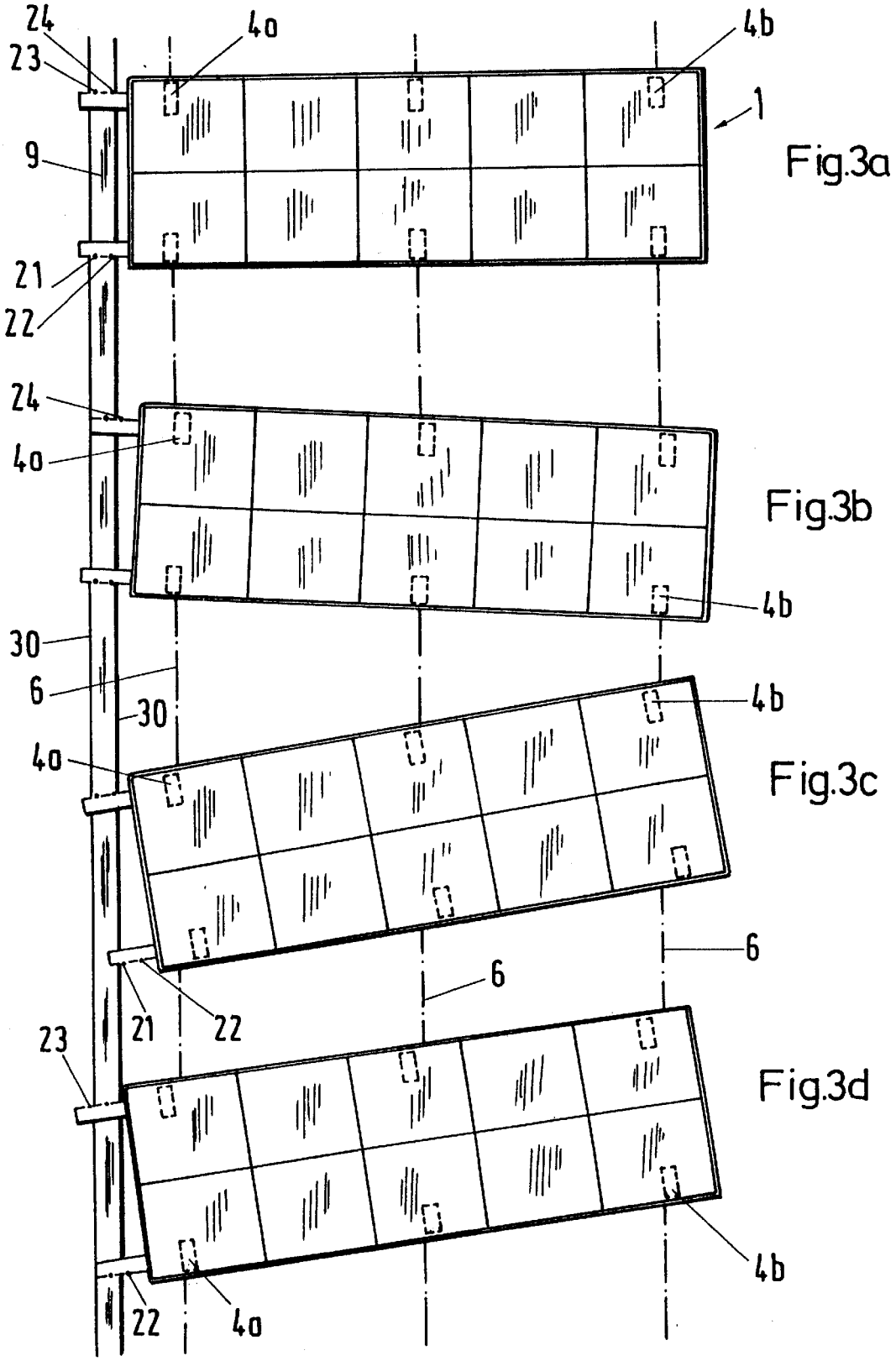
FIG. 3*a* shows in a plan view a shelf member in proper alignment.
FIG. 3*b* shows in a plan view a shelf member with an alignment that needs to be corrected.
FIG. 3*c* shows in a plan view a shelf member with alignment that requires great corrections.
FIG. 3*d* shows in a plan view a shelf member with an alignment that needs great corrections.

FIG. 3*a* shows the ideal position of the shelf member 1 in which the wheels 4 are exactly aligned and positioned on the ideal line 6 of the tracks 5. All sensing elements 21–24 detect the reference element 9 positioned therebelow so that, after processing in the control device, a respective signal is sent to the drive control units that all driven wheels are to be driven with the same rpm. This is especially true for the outer wheels 4*a*, 4*b*.

In the situation according to FIG. 3*b*, the sensing element 24 does not send a detection signal because it is positioned exterior to the longitudinal edge 30 of the reference element 9. The fact that the shelf member 1 is positioned at a slant relative to the driving direction can be derived by the control device from the fact that one of the sensing elements does not detect the reference element 9 and therefore does not send a signal. The orientation of the slanted arrangement can be determined within the scoring logic of the control device with the aid of the identification signal of each particular sensing element. In the present case, the missing signal of the sensing element 24 indicates that the shelf member 1 is slanted in the clockwise direction. The correction of this slanted position then is carried out by controlling the driving of the wheels. In the scenario of FIG. 3*b*, the wheel 4*b* is primarily driven in the upward direction (in the drawing) or the wheel 4*a* is driven in the downward direction (in the drawing). The expression primarily driven indicates either that the corresponding wheel is driven at a higher rpm than the other wheels or that the drive of the respective wheel is switched on before driving the other wheels. It is also possible to use a combination of these two methods.

In the situation represented in FIG. 3*c* the shelf member 1 is positioned at such a great slant that two sensing elements 21, 22 of one group are positioned external to the reference element 9 and thus do not send detection signals to the control device. In this case, a simple correction is not possible and an emergency stop (initiated by the control device) is required. Subsequently, the control device will send corrective control signals so that with alternating forward and backward movement with simultaneous predominant switching of the wheel pairs 4*a*, 4*b* a position correction is carried out. This is also performed with the control logic implemented within the control device.

The situation represented in FIG. 3*d* also results in an emergency stop since the sensing elements 22 and 23 do not send a detection signal. In this situation the predominant activation of the drives for the wheels 4*a*, 4*b* also results in a correction until all sensing elements 21–24 again will send detection signals.

The control logic implemented within the control device in normal driving situations such as in FIG. 3*b* is designed such that the return of the individual wheels 4, 4*a*, 4*b* to the ideal line 6 is not performed along the shortest possible path but the displacement travel for reaching the adjacent shelf member is taken into consideration, i.e., the width of the aisle 2. For this purpose, the shelf arrangement comprises sensors which supply to the control device the distance between the individual shelf members. In this manner, unnecessarily abrupt pivoting movements of the shelf members are prevented. Only in emergency situations such as in FIGS. 3*c* and 3*d* a return of the wheels along the shortest possible path is implemented.

The present invention is, of course, in no way restricted to the specific disclosure of the specification and drawings, but also encompasses any modifications within the scope of the appended claims.

What I claim is:

1. A moveable shelf arrangement comprising:

individual shelf members;

tracks connected to a floor and extending parallel to one another perpendicular to a longitudinal extension of said shelf members;

said tracks having a flat and planar upper side forming a continuous surface flush with the floor:

a set of wheels connected to each one of said shelf members for moving said shelf members on said tracks without said tracks mechanically guiding said wheels;

at least some of said wheels of said set of wheels being driven;

a drive connected to each one of said driven wheels;

a sensor arrangement, including sensing elements connected to each one of said shelf members and at least one reference element in the form of a stationary, elongate profile member extending parallel to said tracks, wherein said sensing elements cooperate with said at least one reference element for sensing alignment and lateral displacement of said wheels relative to an ideal line of movement on said tracks and producing respective alignment and lateral displacement signals;

a drive control unit connected to each one of said driven wheels for correcting said driven wheels in order to align said driven wheels with said ideal line of movement based on the alignment and lateral displacement signals, wherein said sensing elements are connected to said drive control units.

2. A shelf arrangement according to claim 1, wherein said ideal line of movement is a center line of said track.

3. A shelf arrangement according to claim 1, wherein two of said tracks are arranged at opposite ends of said shelf members and wherein said reference element is positioned adjacent to one of said two tracks so as to be spaced from a respective one of said opposite ends.

4. A shelf arrangement according to claim 1, wherein two of said tracks are arranged at opposite ends of said shelf members and wherein said reference element is positioned above one of said two tracks.

5. A shelf arrangement according to claim 1, wherein one of said tracks is said reference element.

6. A shelf arrangement according to claim 1, wherein said sensor arrangement comprises at least four of said sensing elements, said sensing elements divided into a first and a second group.

7. A shelf arrangement according to claim 6, wherein said sensing elements of said first group are arranged in a common plane close to one longitudinal side of said shelf member and said sensing elements of said second group are arranged in a common plane close to the other longitudinal side of said shelf member.

8. A shelf arrangement according to claim 6, wherein said first group and said second group each comprise two said sensing elements, wherein, for a neutral, aligned position of said wheels, said two sensing elements of said first and said second groups, respectively, have a same spacing from a center line of said reference element.

9. A shelf arrangement according to claim 8, wherein said reference element has an upper side with longitudinal edges and wherein said sensing elements are designed to respond to said longitudinal edges.

10. A method for controlling the movement of a shelf arrangement comprising individual shelf members and flat, planar tracks connected to a floor and extending parallel to one another perpendicular to a longitudinal extension of said shelf members, a set of wheels connected to each one of said shelf members for moving said shelf members on said tracks, at least some of said wheels of said set of wheels being driven, a drive connected to each one of said driven wheels, a sensor arrangement connected to each one of said shelf members, a drive control unit connected to each one of said driven wheels, said method comprising the steps of:

arranging the tracks flush with the floor to form a continuous surface with the floor;

continuously monitoring the actual alignment and the actual lateral displacement of said wheels relative to an ideal line of movement with said sensor arrangement;

comparing the actual alignment and the actual lateral displacement to a respective preset threshold value;

correcting at least one of the actual alignment and the actual lateral displacement, when a deviation from the respective preset threshold value has been detected, by sending a corrective control signal to at least one of said drive control units, wherein correction is achieved by at least one of the steps of driving said drive wheels at different rpm and activating said drive wheels at different times.

* * * * *